US006966856B1

(12) United States Patent
Hajek

(10) Patent No.: US 6,966,856 B1
(45) Date of Patent: Nov. 22, 2005

(54) HELICAL BROADHEAD

(76) Inventor: Michael L. Hajek, 27040 124th St., Staples, MN (US) 56479-3333

( * ) Notice: Subject to any disclaimer, the term of this patent is extended or adjusted under 35 U.S.C. 154(b) by 0 days.

(21) Appl. No.: 10/862,648

(22) Filed: Jun. 7, 2004

(51) Int. Cl.[7] ..... F42B 6/08
(52) U.S. Cl. ..... 473/583; 473/584
(58) Field of Search ..... 473/583, 584

(56) References Cited

U.S. PATENT DOCUMENTS 3,604,708 A * 9/1971 Brozina ..... 473/584
4,175,749 A 11/1979 Simo
4,534,568 A 8/1985 Tone
4,565,377 A 1/1986 Troncoso, Jr. et al.
5,257,809 A 11/1993 Carrizosa
6,319,161 B1 11/2001 Martinez et al.
6,663,518 B1 12/2003 Kuhn
6,695,727 B1 2/2004 Kuhn

* cited by examiner

*Primary Examiner*—John A. Ricci
(74) *Attorney, Agent, or Firm*—Gerald E. Helget; Briggs and Morgan, P.A.

(57) ABSTRACT

A helical broadhead for an archery arrow includes a ferrule having a longitudinal axis with a tip end and an arrow end. Aligned forward and rearward slots are located in the ferrule generally parallel to the axis. At least two helical blade assemblies, each with an elongate cutting edge, spiral about the axis from a forward blade tang mounted in one forward slot to a rear tang mounted in a nonaligned, rearward slot. A chiseled tip having a sloping surface aligned with a helical blade assemblies may be attached to the tip end of the broadhead.

16 Claims, 2 Drawing Sheets

HELICAL BROADHEAD

BACKGROUND OF THE INVENTION

The present invention relates to an archery broadhead, and more particularly, to a broadhead with helical blades having elongate cutting edges which impart spin to the arrow in flight to increase accuracy, penetration and hemorrhaging of the target animal.

A bow hunter's goal at all times is accurately place a shot in a killing zone of a big game animal with maximum penetration to establish excessive hemorrhaging and ultimately result in a quick kill and successful animal retrieval thereby avoiding excessive tracking efforts, prolonged pain and suffering to be experience by the animal.

To achieve the hunter's goal, the archery industry has provided faster shooting and more powerful bows with increased percentage of "let off" allowing the hunter to hold the drawn bow longer while aiming. However, with faster and more powerful bows comes problems associated with the accuracy of arrow placement. One aspect to assist in arrow accuracy and stabilization has been the use of offset arrow feather fletching which brings a spin to the arrow to stabilize the arrow during flight and to increase its accuracy.

Broadheads at the tip end of the arrow cut into the target animal to establish hemorrhaging as they pass through vital organs. These known conventional broadhead blades seriously impede the rotation of the arrow and may in fact cause the arrow to wobble and deflect offline.

Expandable broadheads have been developed which maintain a narrow, low profile during flight. The expandable broadheads are effective if the hunter makes an ideal shot, including a successful projected shot angle to avoid bones. Bones cause the arrow to deflect and many times break the blade or divert the blade away from intended vital organs. Also, once the expanded broadhead has stopped, the blades tend to fold back to a non-cutting position, at which point the arrow is easily removed by the animal's mouth, running motion, or trail brush. This eliminates further organ damage and prolonged recovery of the wounded animal.

U.S. Pat. No. 6,319,161 discloses an arrowhead having a plurality of cutting blades with spiral edges to collectively define a generally circular cutting envelope when the arrowhead rotates in flight. However, because the spiral blades have only the leading end locked down to the arrowhead, they appear to be fragile and may easily break upon impact with the target. This is because they lack appropriate strengthening connections between the forward and rearward blade components and are completely mounted within a single slot within the ferrule.

U.S. Pat. No. 6,663,518 is similar to the '161 helical blade design, but less drastic. The individual blades have a rearwardly located slight airfoil shape which may slightly assist in rotating the blade but offer little assistance in penetration.

There is a need for a broadhead with helical blades that impart spin to the arrow in flight but have improved strength and mounting characteristics that provide increased penetration into the target animal which results in massive tissue destruction and hemorrhaging without breakage caused by hitting bone structures.

SUMMARY OF THE INVENTION

A helical broadhead for an archery arrow includes a ferrule having a longitudinal axis with a tip end and an arrow end. Aligned forward and rearward slots are located in the ferrule generally parallel to the axis. At least two helical blade assemblies, each with an elongate cutting edge, spiral about the axis from a forward blade tang mounted in one forward slot to a rear tang mounted in a nonaligned, rearward slot. A chiseled tip having a sloping surface aligned with a helical blade assemblies may be attached to the tip end of the broadhead.

A principle object and advantage of the present invention is that it provides for maximum penetration with a target drawing force to create excessive hemorrhaging caused by the spiraling elongate cutting blades causing a more efficient mortal wound.

Another object and advantage of the present invention is that it provides for a quick kill, successful retrieval, avoiding prolonged pain and suffering, and permits the avoidance of the long tracking process.

Another object and advantage of the present invention is that it provides accurate flight pattern caused by aggressive rotating of the broadhead due to the rifling design thereof.

Another object and advantage of the present invention is that the broadhead is self-penetrating and drawing inwardly which will avoid bone deflection and actually will draw the arrow through the target animal.

Another object and advantage of the present invention is that it provides for minimal friction with continuous cutting through the spiraling drawing energy action of the broadhead.

Another object and advantage of the present invention is that the broadhead spiraling or auger rotation effect reduces broadhead energy loss typical with known arrow shaft friction and torque.

Another object and advantage of the present invention is the improved accuracy in that the broadhead assists the fletching to encourage shaft rotation.

Another object and advantage of the present invention is that its aerodynamic flight imparted to an arrow due rotation and rifling effects of the broadhead encourages precision, accuracy of the arrow placement, optimum velocity and penetration.

Another object and advantage of the present invention is that it allows the archer to reduce the bow draw pulling poundage due to increased arrow velocity, accuracy and broadhead penetration.

Another object and advantage of the present invention is the increased length of the cutting edges of the broadhead while maintaining flight dynamics and optimum penetration without blade breakage of deflection typical of expanding mechanical broadheads.

Another object and advantage of the present invention is that the broadhead point assists in rotation or spiraling along with penetration by its auger rotating design.

Another object and advantage of the present invention is that the broadhead forms a large circular profile hole wound for profuse bleeding and exit channel versus the simple slits of a conventional broadhead.

Another object and advantage of the present invention is that it reduces windage and elevational errors during flight.

Another object and advantage of the present broadhead is that its blade assemblies have improved strength with cross-connection bridges unlike prior spiral cutting blades.

DETAILED SPECIFICATION

Figure 1:
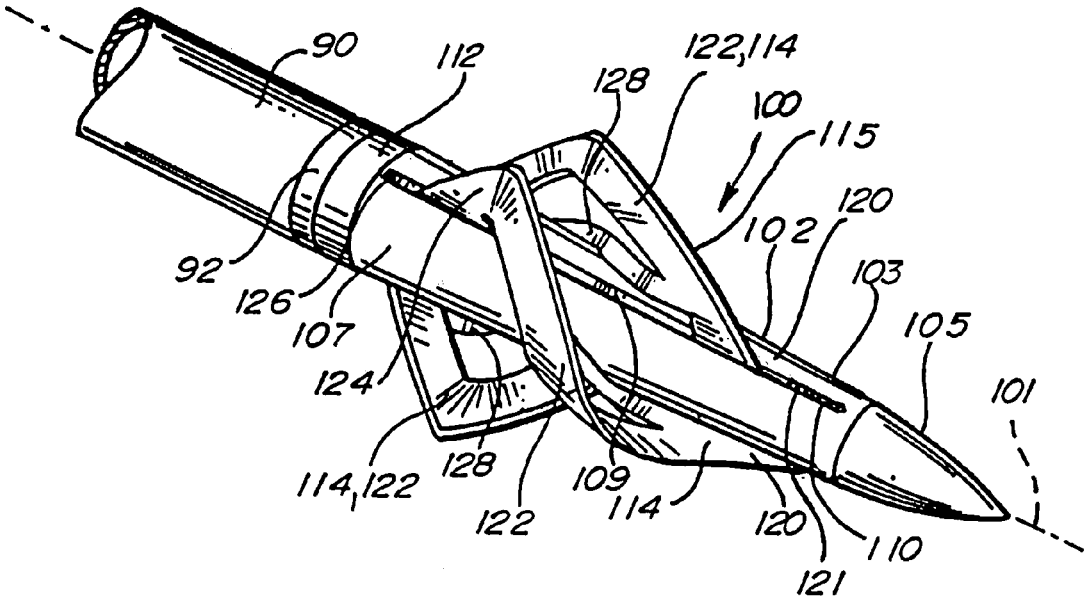
FIG. 1 is a perspective view of the helical broadhead of the present design mounted on the end of an arrow broken away.
Figure 2:
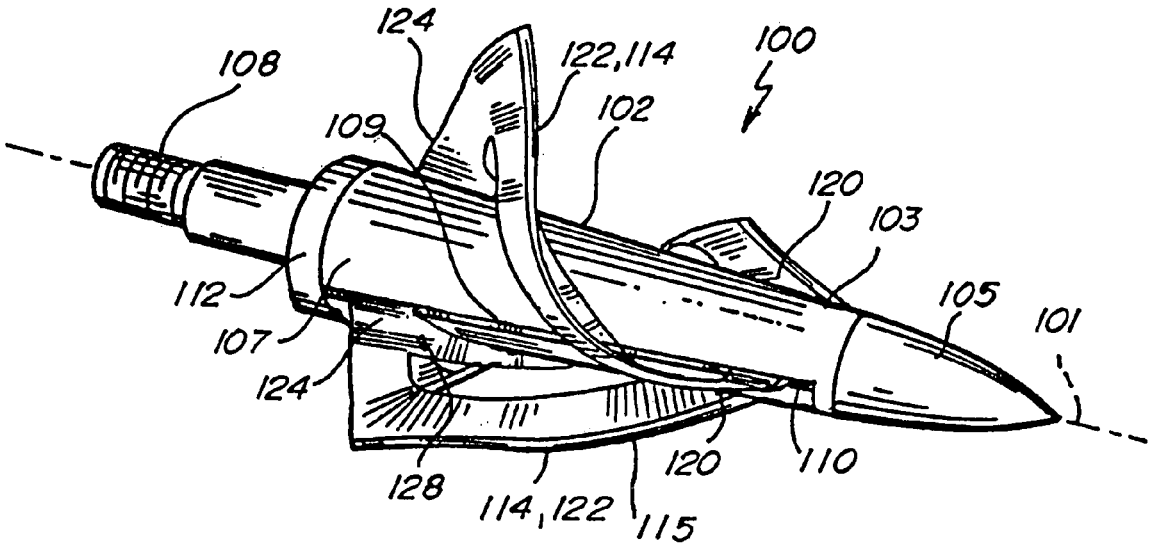
FIG. 2 is another perspective view of the helical broadhead.

Referring to FIGS. 1 and 2, the broadhead 100 of the present invention generally may be appreciated mounted on arrow 90 by way of threaded insert 92. Broadhead 100 generally includes a tip 105 mounted on the ferrule 102 having blade mounting slots 109 in which is secured the blade assemblies 114 held in place by retention collar 112.

More specifically, broadhead 100 includes a longitudinal axis 101 running the length thereof. A body or ferrule 102 has a tip end 103 with a threaded longitudinal aperture 104 shown in FIG. 3. A broadhead trocar, point or tip 105 is secured into the threaded aperture 104 by way of the threaded shank boss or shaft 106 threaded into the longitudinal threaded aperture 104 at the tip end 103.

At the arrow end 107 of the ferrule 102 is located a threaded mounting stub 108. Blade mounting slots 109 are suitably located longitudinally and generally parallel with the axis 101 along the length of the ferrule 102. A slot pocket or forward slot portion 110 is located in the tip end 103 and a retention collar 112 is suitably located to close the rear portion of the slots 109.

Figure 3:
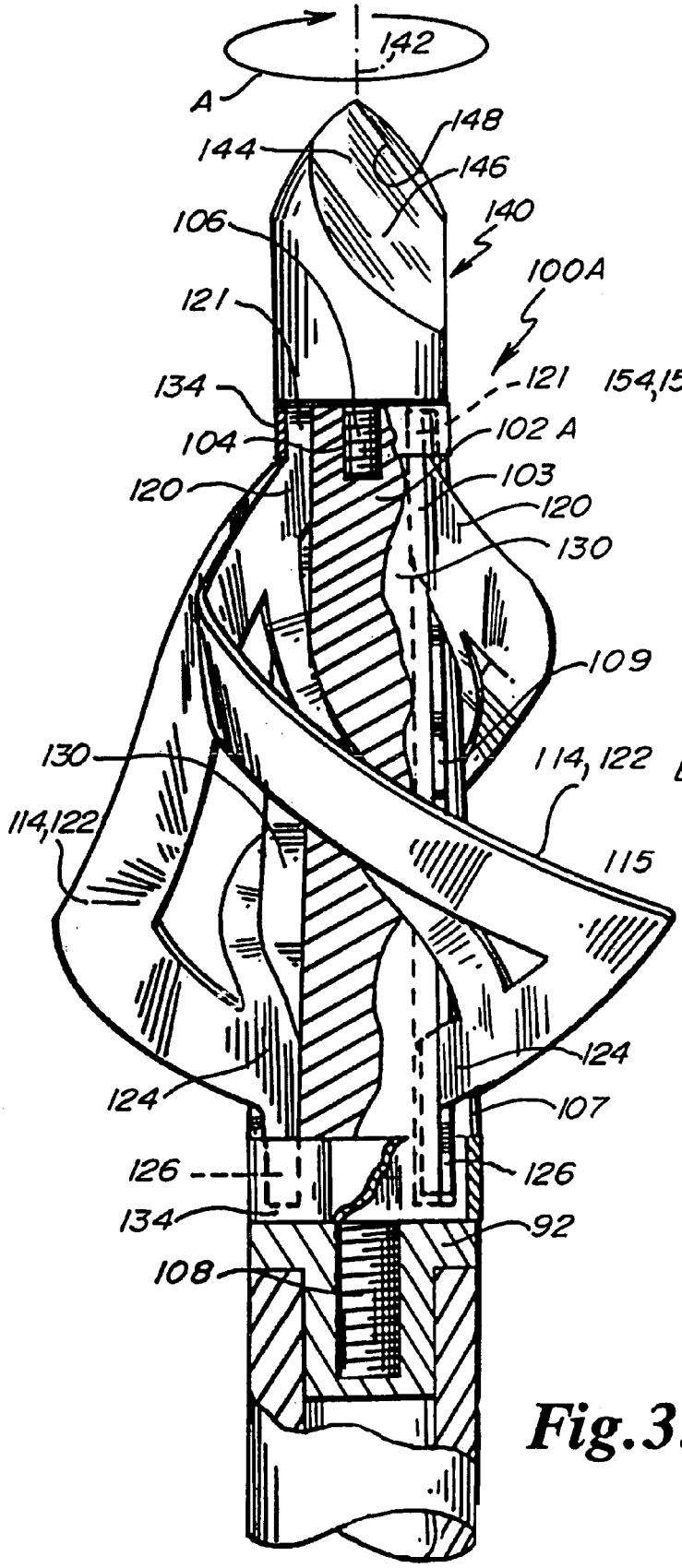
FIG. 3 is an elevational view of the broadhead partially broken away, mounted on an arrow with a chiseled trocar or tip.

Spiraling blade assemblies 114 may be seen in FIGS. 1 through 3. Each blade assembly 112 includes an elongate spiraling cutting edge 115 beginning at first or forward blade portion 120 whereat mounting tang 121 is located. From this first portion of 120 the blade assembly 114 spirals about the axes 101 and 142 to a second middle or intermediate helical portion 122. From there, the blade assembly 114 continues to spiral about the axes to a third rear portion 124 whereat a mounting tang 126 is located. Extending from the forward portion 120 to the third or rear portion 124 is located a bridge or cross-connection 128 which adds strength and stability to the blade assemblies 114.

FIG. 3 shows a slightly modified broadhead 100A with many similar components of the broadhead 100 of FIGS. 1 and 2. This embodiment includes a hollow ferrule sleeve 130 that slideably rotates on ferrule 102A. Slip washers 134 are slid over the ferrule body 102A at the tip end 103 and arrow end 107 which hold tangs 121 and 126 of the blade assemblies 114. By this arrangement, the blade assemblies 114 and ferrule sleeve 130 are permitted to freely rotate which may be desirable. A number of arrangements allowing free rotation of an arrowhead with respect to an arrow shaft are known in the art, particularly as disclosed in U.S. Pat. Nos. 5,257,809; 4,175,749; and 4,534,568, all of which are incorporated herein by reference.

A second broadhead tip embodiment 140 assists in broadhead 100A rotation about access 142. The broadhead tip or trocar 140 has a cut out portion 144 from left to right downwardly to create a slope 146 and a pulling edge 148. By this arrangement, sloping surface 146 assists in rotation of the broadhead 100A along with the arrow 90 in the same rotational fashion as blade assemblies 114 as shown in arrow A about axis 142. The pulling edge 148 pulls the tip 140 forward through the animal and through bone as it rotates at great speed, again, assisting the blade assemblies 114.

Figure 5:
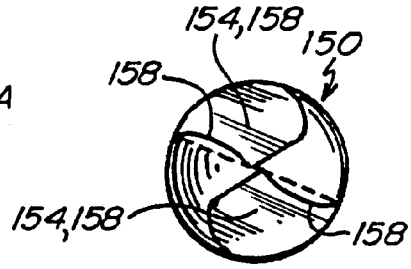
FIG. 5 is a top plan view of the field tip of FIG. 4.
Figure 4:
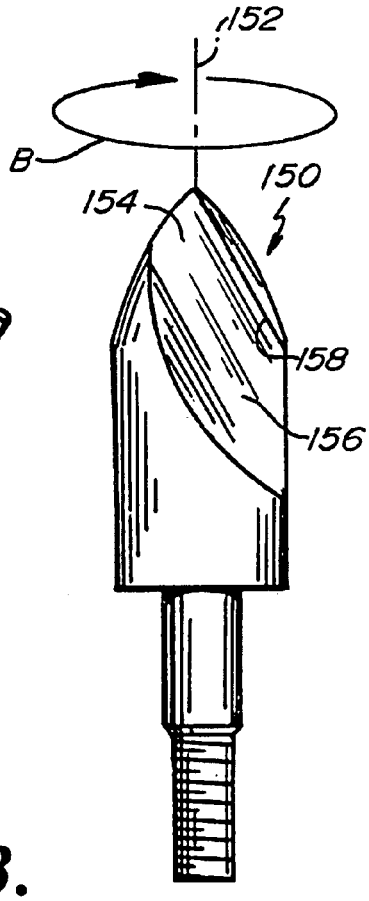
FIG. 4 is a elevational view of a chiseled field tip for an arrow.

FIGS. 4 and 5 show a archery field tip 150 similarly cut to the broadhead tip 140. Field tip 150 rotates about axis 152 and has a cut out portion 154 creating a slope 156 and suitably a pulling edge 158 all of which assist in rotation of the field tip 150 and arrow about axis 152 as shown with arrow B.

The operation of broadhead 100 may now be appreciated. For assembly, the forward tang 121 of plate assembly 114 is inserted into slot pocket 110. The rear tang 126 of the blade assembly 114 is mounted in an adjacent but not aligned rear blade mounting slot 109. Two other blades are similarly assembled after which a retention collar 112 is secured over the rear tangs 126. It will be appreciated that the bridging cross-connection 128 adds strength to the blade assemblies 114 as the bridge rests on top of the ferrule or body 102. Next the broadhead is inserted into the threaded insert 92 of the arrow 90 and broadhead 100 is ready for use.

FIG. 3 shows a slight variation wherein the ferrule sleeve 130 with the captured front and rear tangs 121 and 126 of the blade assemblies 114 are caught and held by slip washers 134 after which the threaded mounting stub 108 of the ferrule 102A may be mounted into the threaded insert 92. Thereafter the broadhead 100A is ready for use.

FIGS. 4 and 5 show a field tip 150 which has similar rotating characteristics as broadheads 100 and 100A. Specifically, after the field tip 150 is mounted onto an arrow 90 by threading into the threaded insert 92, the field tip 150 and arrow 90 may be shot. As the air rushes over the sloping surface 156 of the field tip 150, the tip 150 and arrow rotate about axis 152 as shown by way of arrow B. Optionally, the pulling edge 158 may be used where desirable to pull the field tip 150 into the target.

The present invention in the above specification and referenced figures are for illustrative purposes only. The true scope of the present invention may be learned from the following claims as the specification is for illustrative purposes only.

What is claimed is:

1. A helical broadhead for an archery arrow, comprising:

(a) a ferrule having a longitudinal axis with a tip end and an arrow end with forward and rearward slots generally parallel to the axis located in the tip end and the arrow end; and (b) at least two helical blade assemblies each with an elongate cutting edge spiraling about the axis from a forward blade portion mounted in a forward slot to a rear portion mounted in a rearward slot;

(c) wherein the forward and rearward slots are aligned and form at least two nonaligned groups of slots.

2. The helical broadhead of claim 1, wherein the helical blade assemblies each have a forward and a rearward blade tang for mounting in a slot.

3. The helical broadhead of claim 2, wherein the forward and rearward tangs of each blade assembly are mounted in nonaligned slots.

4. The helical broadhead of claim 1, further comprising a bridging cross connection between the forward blade portion and the rearward blade portion.

5. The helical broadhead of claim 1, further comprising a chisled tip secured to the tip end of the ferrule having sloping surface aligned with the helical blade assemblies.

6. The helical broadhead of claim 1, wherein the ferrule further comprises a hollow ferrule sleeve freely rotatable with respect to the broadhead.

7. A helical broadhead for an archery arrow, comprising:

(a) a ferrule having a longitudinal axis with a tip end and an arrow end with forward and rearward aligned slots generally parallel to the axis located in the tip end and the arrow end forming at least two nonaligned groups of slots; and (b) at least two helical blade assemblies each with an elongate cutting edge spiraling about the axis from a forward blade tang mounted in a forward slot to a rear tang mounted in a rearward slot.

8. The helical broadhead of claim 7, wherein the forward and rearward tangs of each blade assembly are mounted in nonaligned slots.

9. The helical broadhead of claim 7, further comprising a bridging cross-connection between a forward blade portion and a rearward blade portion.

10. The helical broadhead of claim 7, further comprising a chisled tip secured to the tip end of the ferrule having scoping surface aligned with the helical blade assemblies.

11. The helical broadhead of claim 7, wherein the ferrule further comprises a hollow ferrule sleeve freely rotatable with respect to the broadhead.

12. A helical broadhead for an archery arrow, comprising:

(a) a ferrule having a longitudinal axis with a tip end and an arrow end with equally spaced slots generally parallel to the axis located in the tip end and the arrow end; and (b) three helical blade assemblies each with an elongate cutting edge spiraling about the axis from a forward blade tang mounted in one slot to a rear tang mounted in an adjacent slot.

13. The helical broadhead of claim 12, further comprising a bridging cross-connection between a forward blade portion and a rearward blade portion.

14. The helical broadhead of claim 12, further comprising a chiseled tip secured to the tip end of the ferrule having scoping surface aligned with the helical blade assemblies.

15. The helical broadhead of claim 12, wherein the ferrule further comprises a hollow ferrule sleeve freely rotatable with respect to the broadhead.

16. A helical broadhead for an archery arrow, comprising:

(a) a ferrule having a longitudinal axis with a tip end and an arrow end with forward and rearward aligned slots generally parallel to the axis located in the tip end and the arrow end forming at least two nonaligned groups of slots;

(b) at least two helical blade assemblies each with an elongate cutting edge spiraling about the axis from a forward blade tang mounted in a forward slot to a rear tang mounted in a nonaligned rearward slot;

(c) a bridging cross-connection between a forward blade portion and a rearward blade portion; and (d) a chiseled tip secured to the tip end of the ferrule having sloping surface aligned with the helical blade assemblies.

* * * * *